US009886003B2

(12) United States Patent
Fujisawa

(10) Patent No.: US 9,886,003 B2
(45) Date of Patent: Feb. 6, 2018

(54) ELECTRONIC TIMEPIECE

(71) Applicant: Seiko Epson Corporation, Tokyo (JP)

(72) Inventor: Teruhiko Fujisawa, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/851,298

(22) Filed: Sep. 11, 2015

(65) Prior Publication Data

US 2016/0103428 A1 Apr. 14, 2016

(30) Foreign Application Priority Data

Oct. 9, 2014 (JP) ..... 2014-208140

(51) Int. Cl.

| | |
|---|---|
| ***G04R 60/00*** | (2013.01) |
| ***G04R 60/02*** | (2013.01) |
| ***G04R 60/10*** | (2013.01) |
| ***G04R 60/12*** | (2013.01) |
| ***G04R 60/06*** | (2013.01) |
| ***G04B 19/24*** | (2006.01) |
| ***G04R 20/04*** | (2013.01) |
| ***G04B 19/247*** | (2006.01) |
| *H01Q 1/38* | (2006.01) |

(52) U.S. Cl.

CPC ..... *G04B 19/24* (2013.01); *G04B 19/247* (2013.01); *G04R 20/04* (2013.01); *G04R 60/00* (2013.01); *G04R 60/02* (2013.01); *G04R 60/10* (2013.01); *G04R 60/12* (2013.01); *H01Q 1/38* (2013.01)

(58) Field of Classification Search

CPC ..... G04R 60/00; G04R 60/02; G04R 60/06; G04R 60/10; G04R 60/12; H01Q 1/38

USPC ..... 368/47

See application file for complete search history.

(56) References Cited

U.S. PATENT DOCUMENTS

| | | | | |
|---|---|---|---|---|
| 5,642,120 | A * | 6/1997 | Fujisawa | H01Q 1/22 343/702 |
| 8,855,730 | B2 * | 10/2014 | Sanford | H01Q 21/0087 455/575.7 |
| 2004/0145975 | A1 * | 7/2004 | Barras | G04G 21/04 368/281 |
| 2004/0233789 | A1 | 11/2004 | Oguchi et al. | |

(Continued)

FOREIGN PATENT DOCUMENTS

| | | |
|---|---|---|
| JP | 2007-292787 A | 11/2007 |
| JP | 2012-013627 A | 1/2012 |

(Continued)

OTHER PUBLICATIONS

Hosaka et al., English Translation of JP 2012198150 A, originally published Oct. 18, 2012, full document.*

*Primary Examiner* — Amy Cohen Johnson
*Assistant Examiner* — Daniel Wicklund
(74) *Attorney, Agent, or Firm* — Harness, Dickey & Pierce, P.L.C.

(57) ABSTRACT

An electronic timepiece has a base plate made from a non-conductive material, and a planar antenna disposed on the back side of the base plate. The planar antenna has a dielectric substrate and an antenna electrode disposed to the base plate side of the dielectric substrate. An exposed area not superimposed with the antenna electrode 42 is formed on the surface of the dielectric substrate. The base plate has a through-hole overlapping at least part of the antenna electrode in plan view, and a cover part overlapping at least part of the exposed surface in plan view.

5 Claims, 10 Drawing Sheets

(56) References Cited

U.S. PATENT DOCUMENTS

| | | | | |
|---|---|---|---|---|
| 2006/0227058 | A1* | 10/2006 | Zellweger | H01Q 1/273 343/718 |
| 2010/0060540 | A1* | 3/2010 | Abe | H01Q 7/08 343/788 |
| 2010/0097896 | A1* | 4/2010 | Baba | G01S 19/14 368/47 |
| 2011/0051561 | A1* | 3/2011 | Fujisawa | G04G 5/002 368/47 |
| 2012/0002511 | A1 | 1/2012 | Matsuzaki | |
| 2014/0086027 | A1* | 3/2014 | Yanagisawa | G04G 17/045 368/278 |
| 2015/0016229 | A1* | 1/2015 | Yanagisawa | G04R 60/12 368/47 |
| 2016/0103429 | A1* | 4/2016 | Fujisawa | G04R 60/12 368/37 |
| 2016/0161920 | A1* | 6/2016 | Fujisawa | G04G 17/04 368/80 |

FOREIGN PATENT DOCUMENTS

| | | | | |
|---|---|---|---|---|
| JP | 2012-194137 | A | | 10/2012 |
| JP | 2012198150 | A | * | 10/2012 |
| JP | 2012-211895 | A | | 11/2012 |
| JP | 2013-040793 | A | | 2/2013 |

* cited by examiner

ELECTRONIC TIMEPIECE

BACKGROUND

1. Technical Field

The present invention relates to an electronic timepiece, and relates more particularly to an electronic timepiece with a planar antenna.

2. Related Art

JP-A-2012-13627 describes an electronic timepiece with a planar antenna for receiving radio frequency signals transmitted from GPS (Global Positioning System) or other types of positioning information satellites.

The electronic timepiece in JP-A-2012-13627 has a planar antenna disposed on the back cover side of the dial, and suppresses loss of antenna sensitivity by separating the planar antenna from the metal case around the antenna.

Disposing the planar antenna closer to the base plate that is also disposed on the back cover side of the dial is desirable to make the electronic timepiece thinner. Because the base plate is made of plastic or other non-conductive material, the base plate does not interfere with radio waves, and the planar antenna can receive radio signals even with the planar antenna disposed adjacent to the base plate.

Because the base plate is a dielectric, however, a new problem of the antenna frequency shifting occurs if the gap between the base plate and the antenna electrode is too small. More specifically, the antenna frequency begins shifting if the gap between the base plate and the antenna electrode of the planar antenna is less than approximately 1.0 mm. The problem becomes particularly acute if this gap is 0.5 mm or less because the frequency shift increases with even the slightest change in the gap between the base plate and the antenna electrode, reception performance drops, and antenna characteristics are not stable.

SUMMARY

The present invention provides an electronic timepiece that is thin and maintains stable antenna characteristics.

An electronic timepiece according to a preferred aspect of the invention has a base plate made from a non-conductive material; and a planar antenna disposed on the back cover side of the base plate and including a dielectric substrate and an antenna electrode disposed to the surface of the dielectric substrate on the base plate side, and an exposed surface where the antenna electrode is not present formed on the surface of the dielectric substrate. The base plate has a through-hole overlapping the antenna electrode at least in part in plan view, and a cover part overlapping the exposed surface at least in part in plan view.

Because a through-hole that overlaps the antenna electrode of the planar antenna in plan view is formed in the base plate, less of the base plate or dielectric is in proximity to the antenna electrode when the planar antenna is placed close to the base plate than when a through-hole is not formed, the shift in the antenna frequency can be reduced, and antenna performance can be stabilized. Furthermore, because the planar antenna can be located near the base plate, the movement that houses the planar antenna can also be made thinner, and an electronic timepiece having the movement can be made thinner.

A cover part that overlaps at least part of the exposed surface in plan view is also formed to the base plate. As a result, movement of the planar antenna to the base plate side can be limited by the exposed surface directly or indirectly contacting the cover part. The planar antenna can therefore be prevented from passing through the through-hole in the base plate and striking the dial or other member in the event the electronic timepiece is dropped, for example.

An electronic timepiece preferably also has a shock absorber is disposed between the cover part and the exposed surface.

Because a shock absorber is placed between the cover parts of the base plate and the exposed surface of the dielectric substrate, the planar antenna can be precisely positioned in the height (thickness) direction of the electronic timepiece by setting the exposed surface of the planar antenna against the shock absorber. As a result, the positioning precision of the planar antenna to the base plate can be improved, change in the antenna frequency due to deviation in positioning precision can be further reduced, and antenna performance can be further stabilized.

Furthermore, because the exposed surface of the planar antenna contacts a sponge or other shock absorbing member, direct contact with the cover parts can be prevented. Damage to the ceramic dielectric substrate can also be prevented even if the dielectric substrate of the planar antenna is made from a hard, easily chipped ceramic because the dielectric substrate does not directly contact the base plate.

In an electronic timepiece according to another aspect of the invention, the through-hole is formed overlapping at least all of the antenna electrode in plan view.

In this aspect of the invention a through-hole formed in the base plate is made so that it does not completely overlap the antenna electrode in plan view. Because a through-hole in the base plate is therefore opposite the antenna electrode and the dielectric base plate is not opposite the antenna electrode, change in the antenna frequency can be further reduced and stable antenna performance can be achieved. In addition, the antenna electrode can be disposed in the through-hole in the base plate, and the thickness of the movement can be reduced.

An electronic timepiece according to another aspect of the invention also has a calendar wheel made from a non-conductive material and displaying calendar information; and the planar antenna is disposed to a position overlapping the calendar wheel in plan view.

Because the date wheel or other calendar wheel is made from a non-conductive material, there is no interference with signal reception even if the calendar wheel overlaps the planar antenna in plan view. Furthermore, because the pivots of the hour, minute, and second hands and other information indicators pass through the dial and base plate, the pivots must be disposed to plane positions outside the area of the date wheel and planar antenna. As a result, disposing the planar antenna to a position overlapping the calendar wheel in plan view affords greater freedom locating the pivots than a configuration in which the planar antenna and calendar wheel do not overlap, and thereby provides greater freedom designing the electronic timepiece.

An electronic timepiece according to another aspect of the invention preferably also has a solar panel disposed to the face side of the base plate not overlapping the planar antenna in plan view.

For example, the solar panel can be disposed not overlapping the planar antenna by creating a notch in the solar panel at a position superimposed with the planar antenna in plan view.

The solar panel includes electrodes, but because the solar panel and the planar antenna do not overlap each other in plan view in the invention, radio waves passing from the face side of the timepiece are picked up by the antenna without being obstructed by the solar panel. A solar panel can therefore be provided in the electronic timepiece without reducing reception performance.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures. Note that the crystal 31 side of the electronic timepiece 1 according to this embodiment of the invention is also referred to as the face, front, or top side, and the back cover 12 side is also referred to as the back or bottom side of the electronic timepiece 1.

Figure 1:
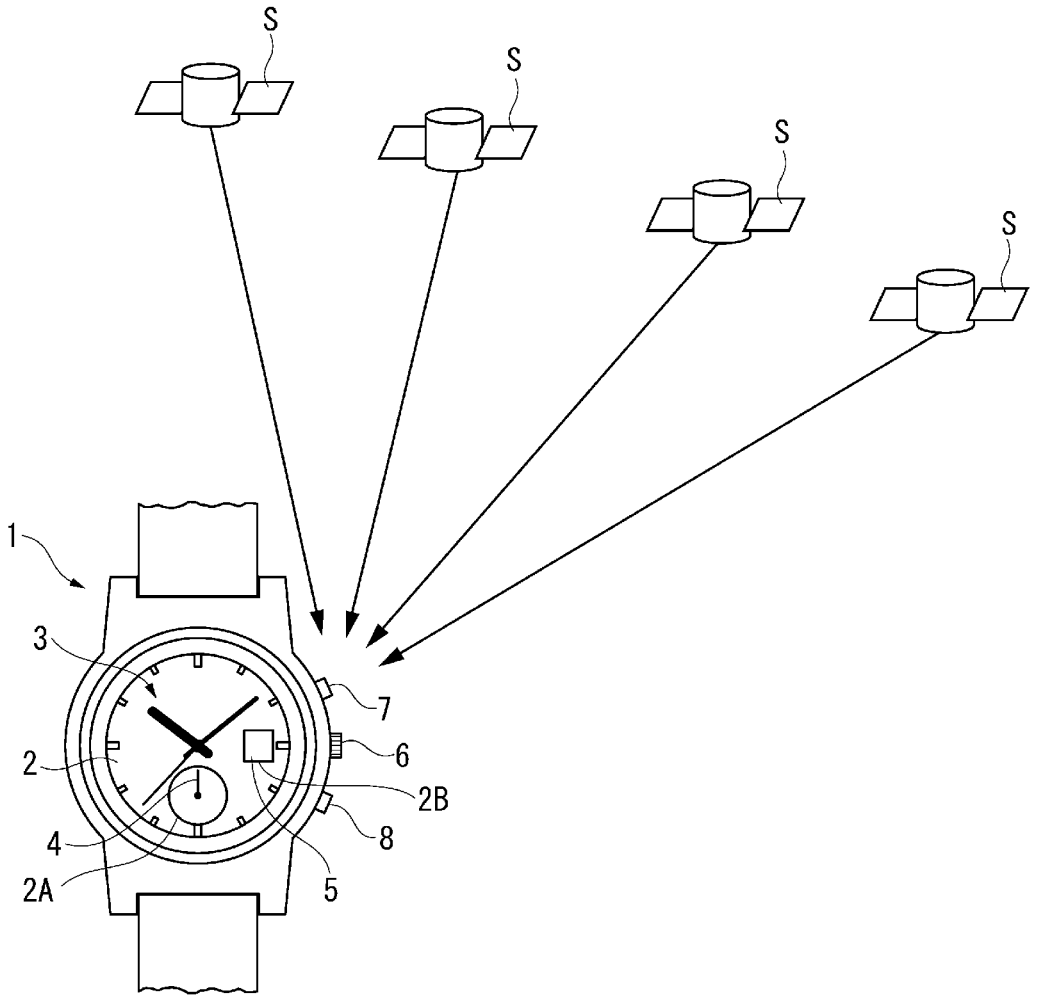
FIG. 1 illustrates an electronic timepiece according to the invention.
Figure 2:
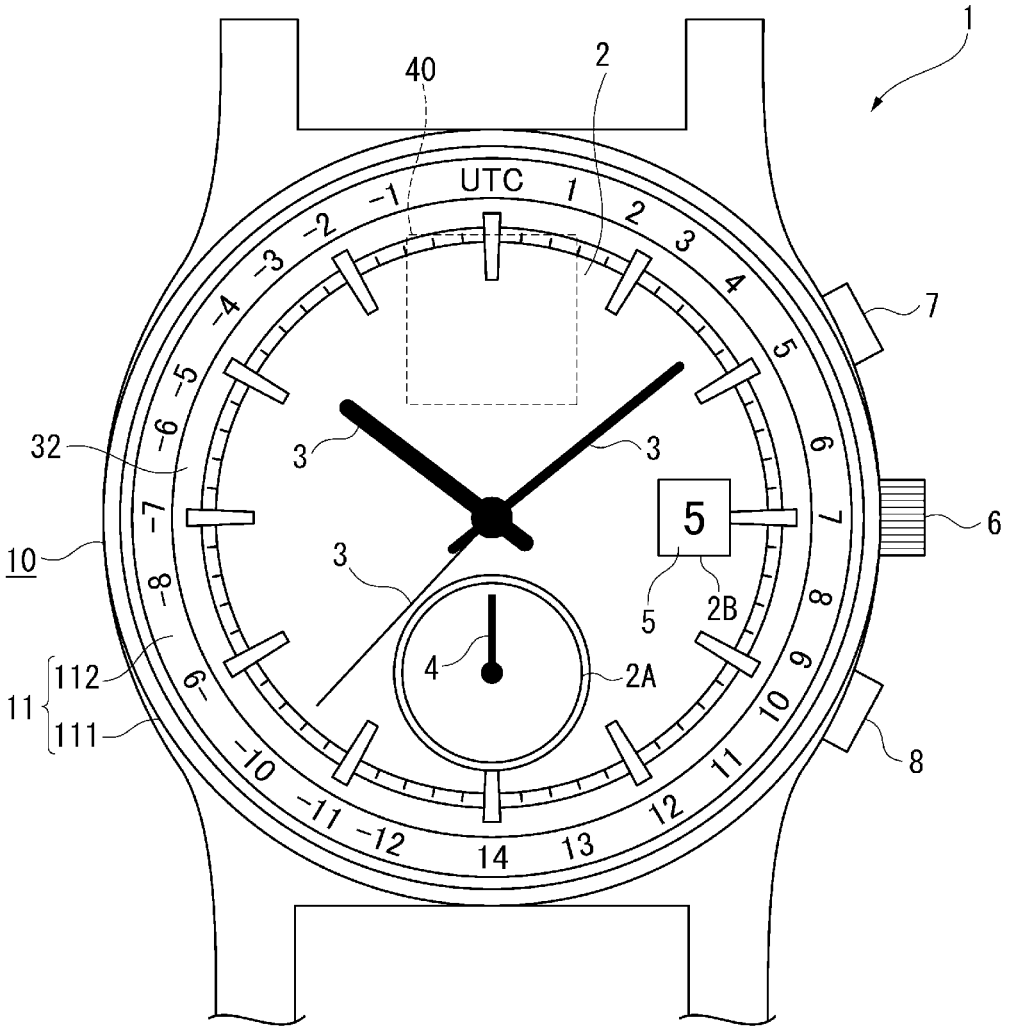
FIG. 2 is a plan view of the electronic timepiece.

As shown in FIG. 1 and FIG. 2, the electronic timepiece 1 is a wristwatch with a time display unit for displaying the time using a dial 2 and hands 3, an information display unit including a subdial 2A of the dial 2 and a hand 4, and a calendar display unit including a window 2B in the dial 2 and a date wheel 5.

Figure 3:
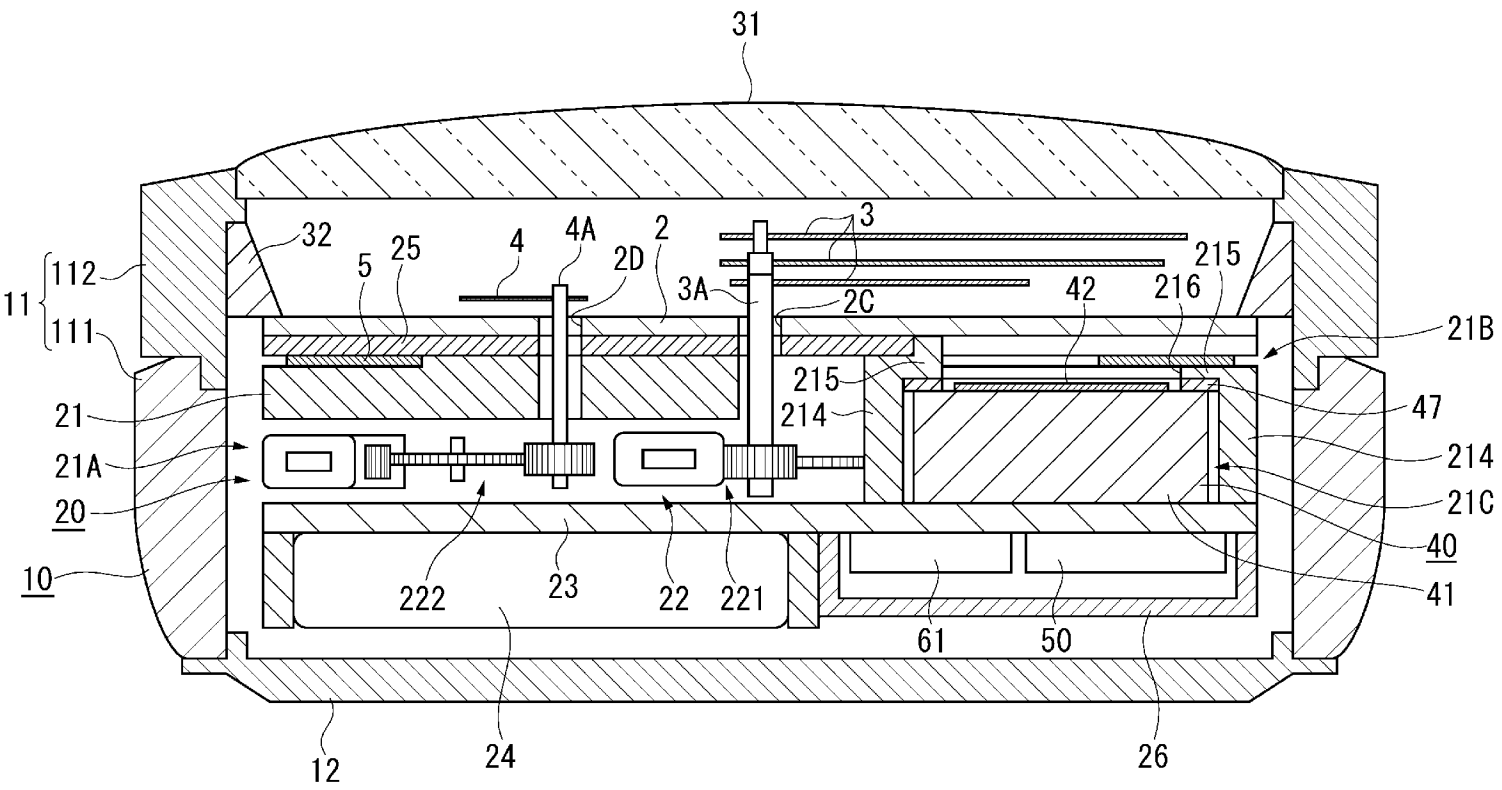
FIG. 3 is a section view of the electronic timepiece.
Figure 4:
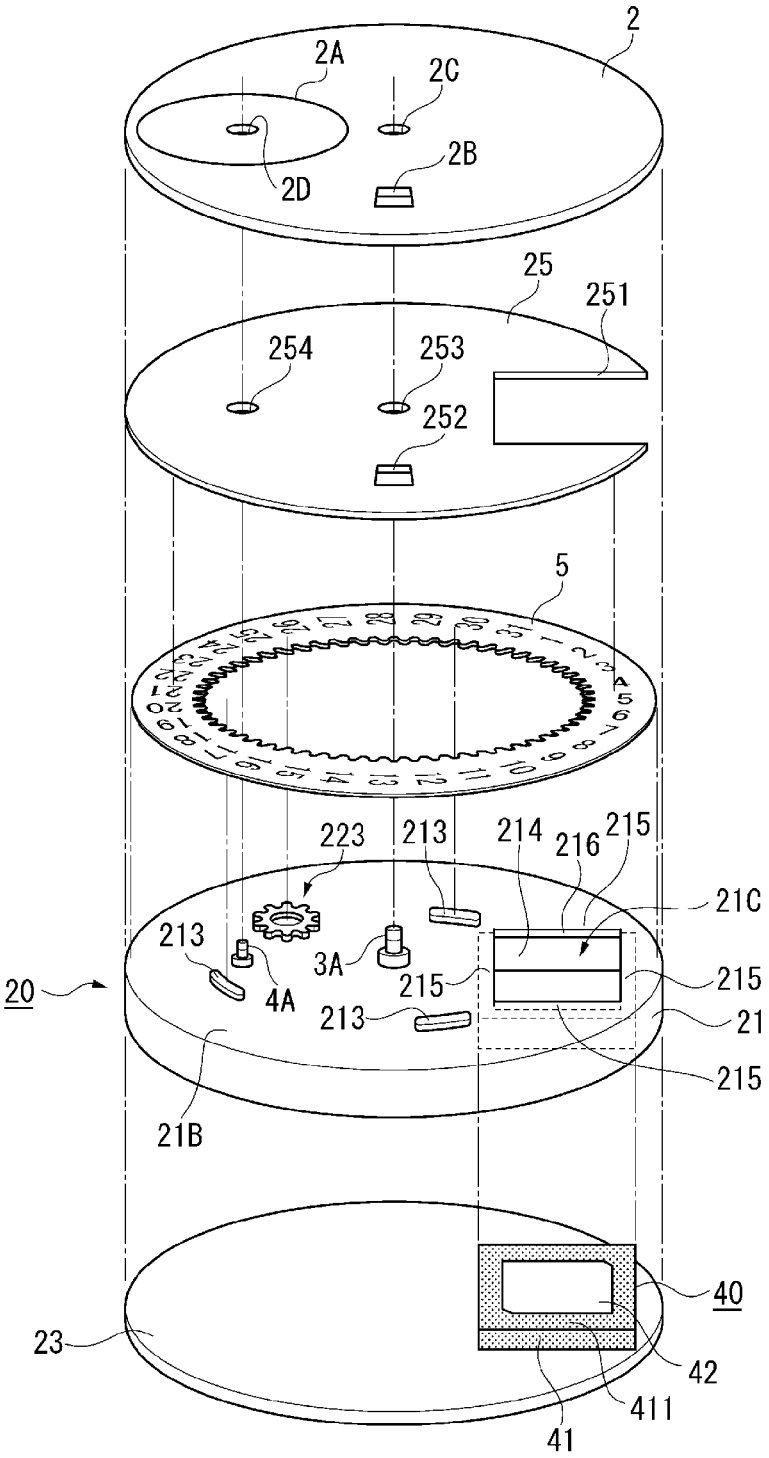
FIG. 4 is a partially exploded oblique view of the electronic timepiece.

The dial 2 is a disc-shaped member made of polycarbonate or other non-conductive material. The subdial 2A is located at 6:00 on the dial 2, and the window 2B is located at 3:00 on the dial 2. In addition to the subdial 2A and window 2B, the dial 2 has a through-hole 2C through which the center pivot 3A of the hands 3 passes, and a through-hole 2D through which the pivot 4A of the small hand 4 passes, as shown in FIG. 3 and FIG. 4. Note that the information display unit comprising the subdial 2A and hand 4 (small hand) may be used to indicate the current operating mode of the timepiece, the day of the week, the remaining battery capacity, or other information.

The hands 3 include a second hand, minute hand, and hour hand. The hands 3, 4 and date wheel 5 are driven by a drive mechanism including a stepper motor and wheel train described further below.

The electronic timepiece 1 also has a crown 6 and buttons 7 and 8 as external operating members.

The electronic timepiece 1 receives satellite signals and acquires satellite time information from the plural GPS satellites S orbiting the Earth on known orbits, and can correct internal time information based on the acquired satellite time information.

Note that the GPS satellites S shown in FIG. 1 are just one example of positioning information satellites, and numerous GPS satellites S are in orbit. There are presently approximately 30 GPS satellites S in service.

External Structure of the Electronic Timepiece

As shown in FIG. 2 and FIG. 3, the electronic timepiece 1 has a case 10 that houses a movement 20 described further below. The case 10 includes the main case 11, and the back cover 12.

The main case 11 includes a tubular outside case member 111, and a bezel 112 disposed on the front side of the outside case member 111.

The bezel 112 is shaped like a ring with the outside of the bezel 112 continuous to the outside of the outside case member 111. The bezel 112 and outside case member 111 are connected by an interlocking tongue-and-groove structure formed on their mutual opposing surfaces, or by adhesive or double-sided adhesive tape, for example. The bezel 112 may also be attached so that it can rotate on the outside case member 111.

The crystal 31 is attached to the inside of the bezel 112 as a cover member held by the bezel 112.

A round back cover 12 is disposed to the back cover side of the outside case member 111 covering the back cover side opening to the outside case member 111. The back cover 12 and the outside case member 111 screw together.

Note that the outside case member 111 and the back cover 12 are discrete members in this embodiment of the invention, but the invention is not so limited and the outside case member 111 and back cover 12 may be formed in unison as a single piece.

The outside case member 111, bezel 112, and back cover 12 are made of brass, stainless steel, titanium alloy, or other conductive metal material.

Internal Configuration of the Electronic Timepiece

The internal structure housed in the case 10 of the electronic timepiece 1 is described next.

As shown in FIG. 2, FIG. 3, and FIG. 4, a movement 20, planar antenna 40 (patch antenna), date wheel 5, and dial ring 32 are housed in addition to the dial 2 inside the case 10.

The movement 20 includes the base plate 21, a drive module 22 supported by the base plate 21, a circuit board 23, a storage battery 24, and a solar panel 25.

The base plate 21 is made from plastic or other non-conductive material. The base plate 21 includes a drive module housing 21A that holds the drive module 22, a date wheel housing 21B where the date wheel 5 is disposed, and an antenna housing 21C that holds the planar antenna 40.

The date wheel housing 21B is a ring-shaped area on the outside side of plural guide parts 213 that protrude up from the face side (the dial 2 side) of the base plate 21. Movement in the plane direction of the date wheel 5 disposed in the date wheel housing 21B is limited by the guide parts 213.

Figure 5:
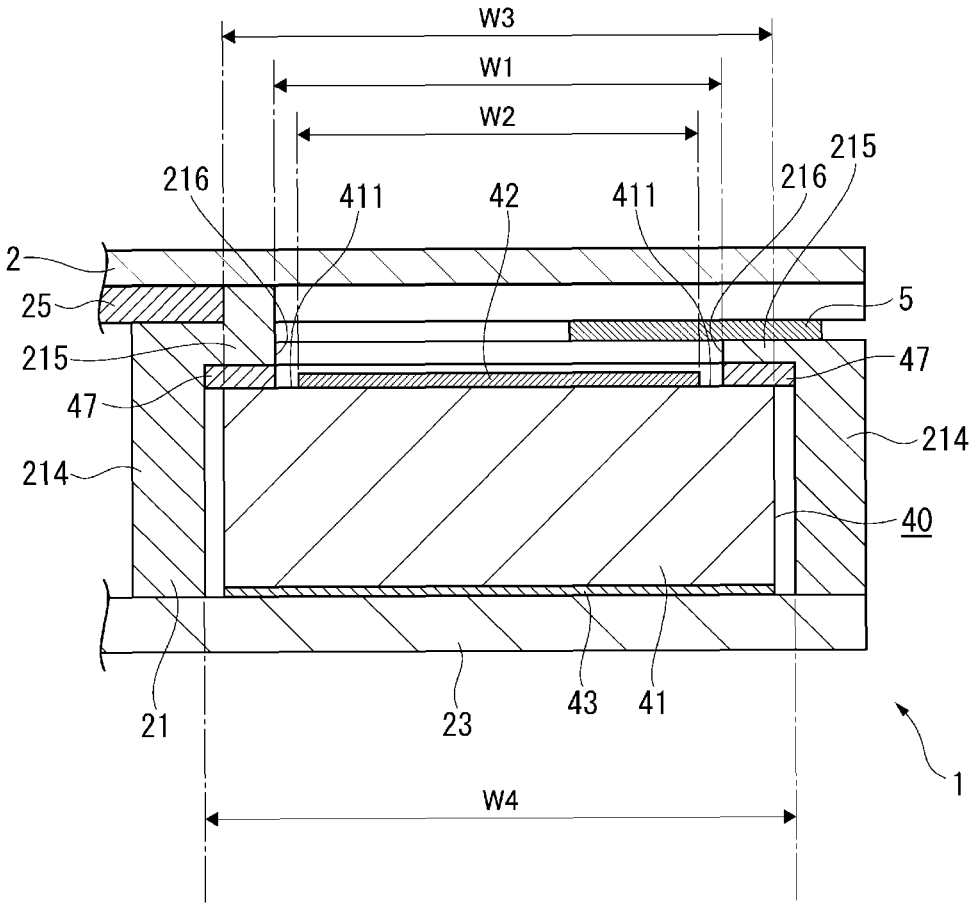
FIG. 5 is a section view illustrating the relative positions of the planar antenna and a through-hole in the base plate of the electronic timepiece.
Figure 6:
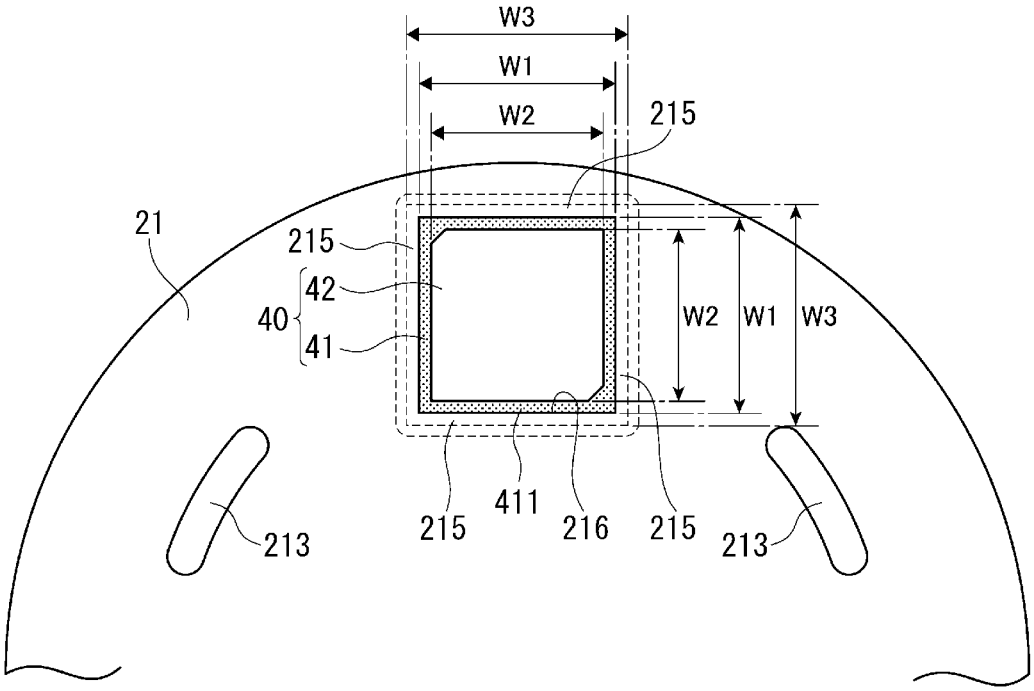
FIG. 6 is a plan view illustrating the relative positions of the planar antenna and a through-hole in the base plate of the electronic timepiece.

The drive module housing 21A and antenna housing 21C are disposed on the back side of the base plate 21. As shown in FIG. 5 and FIG. 6, the antenna housing 21C has four walls 214 (only two shown in FIG. 5) facing the four sides of the planar antenna 40, and four cover parts 215 (only two shown in FIG. 5) protruding from the walls 214 and opposing the front side of the planar antenna 40. A through-hole 216 overlapping at least part of the antenna electrode 42 of the planar antenna 40 in plan view is formed between the cover parts 215. Note that the four walls 214 are formed in unison, and the four cover parts 215 are formed in unison.

Because the antenna housing 21C is at 12:00 on the dial 2 in plan view, the planar antenna 40 is also located at 12:00 as shown in FIG. 2.

The drive module 22 is held in the drive module housing 21A of the base plate 21, and drives the time display unit, information display unit, and date display unit. More specifically, the drive module 22 includes a drive mechanism 221 with a stepper motor and wheel train for driving the hands 3, a drive mechanism 222 with a stepper motor and wheel train for driving the hand 4, and a drive mechanism 223 including a stepper motor and wheel train for driving the date wheel 5 (see FIG. 4).

The top side of the circuit board 23 contacts the back side of the base plate 21, and is attached to the base plate 21 by screw or other fastener. The planar antenna 40 is mounted on the face side of the circuit board 23. A reception module 50 that processes satellite signals received from the GPS satellites S, and a control unit 61 that controls the drive mechanisms 221 to 223, are mounted on the back side of the circuit board 23. The reception module 50 and control unit 61 are located on the opposite side of the circuit board 23 as the planar antenna 40. The reception module 50 and control unit 61 are also enclosed in a shield 26. As a result, signals received by the planar antenna 40 are protected from noise produced by the reception module 50 and control unit 61.

A lithium ion battery is used for the storage battery 24. The storage battery 24 supplies power to the drive module 22, reception module 50, and control unit 61. The storage battery 24 is also disposed to the back side of the circuit board 23 at a position not overlapping the reception module 50 and control unit 61 in plan view.

The surface electrode on the top side of the solar panel 25 is made from indium tin oxide (ITO) or other transparent electrode material to pass light. A amorphous silicon semiconductor thin film is formed as the photovoltaic layer on a plastic film base layer.

Because GPS satellite signals are high frequency signals of approximately 1.5 GHz, GPS signals are attenuated by even the thin transparent electrode of the solar panel, unlike the long wave standard time signals that are received by radio-controlled timepieces, and antenna performance drops. As a result, a notch 251 is formed in the disc-shaped solar panel 25 at the position overlapping the planar antenna 40 in plan view. The solar panel 25 therefore covers the face side of the base plate 21 but does not cover the planar antenna 40. The planar antenna 40 can therefore receive radio waves through the notch 251 in the solar panel 25.

Note that an opening 252 superimposed in plan view with the window 2B in the dial 2, a hole 253 through which the center pivot 3A of the hands 3 passes, and a hole 254 through which the pivot 4A of the small hand 4 passes, are also formed in the solar panel 25.

The planar antenna 40, which is a patch antenna (microstrip antenna), is disposed in the antenna housing 21C. The planar antenna 40 receives satellite signals from GPS satellites S. The planar antenna 40 is described further below in detail.

The date wheel 5, which is a ring-shaped calendar wheel having date numbers displayed on the surface, is held in the date wheel housing 21B of the base plate 21. The date wheel 5 is made from plastic or other non-conductive material. In plan view, the date wheel 5 overlaps at least part of the planar antenna 40. Note that the calendar wheel is not limited to a date wheel 5, and may be a day wheel showing the days of the week, or a month wheel showing the months.

The dial 2 is disposed to the face side of the base plate 21 covering the solar panel 25 and the date wheel 5. The dial 2 is made from a material such as plastic that is non-conductive and transparent to at least some light.

Abbreviations or other markings can be disposed to the surface of the dial 2 overlapping the planar antenna 40 in plan view. To improve the reception performance of the planar antenna 40, these parts are preferably made from plastic or other non-conductive material instead of metal.

Because the dial 2 is transparent, the solar panel 25 located on the back side of the dial 2 can be seen through the dial 2 from the front of the timepiece. The color of the dial 2 appears different in the areas where the solar panel 25 is present and where the solar panel 25 is not present. Design accents may be added to the dial 2 so that this color different is not conspicuous.

By forming the notch 251 in the solar panel 25, the color tone of the dial 2 in the part overlapping the notch 251 appears different from the tone in other parts of the dial 2. To prevent this, a plastic sheet of the same color (such as dark blue or purple) as the solar panel 25 may be disposed below the solar panel 25, or the signal-blocking electrode layer may be removed only in the part overlapping the planar antenna 40 in plan view instead of cutting completely through the solar panel 25 so that the plastic film base layer remains and the color of the solar panel 25 is the same throughout.

A dial ring 32 that is made of a plastic non-conductive material in a ring shape is disposed to the face side of the dial 2. The dial ring 32 is disposed around the circumference of the dial 2, is conically shaped with the inside circumference surface sloping down to the dial 2, and has 60 minute markers printed on the inside sloping surface. The dial ring 32 is held pressed against the dial 2 by the bezel 112.

In plan view, the planar antenna 40 does not overlap the main case 11 (outside case member 111 and bezel 112) and solar panel 25, but does overlap the date wheel 5, dial 2, and crystal 31, which are made from non-conductive materials. More specifically, all parts of the electronic timepiece 1 that are over the face side of the planar antenna 40 in plan view are made from non-conductive materials.

As a result, satellite signals passing from the face side of the timepiece pass through the crystal 31, pass through the dial 2, date wheel 5, and base plate 21 without interference from the main case 11 or solar panel 25, and are incident to the planar antenna 40. Note that because the hands 3, 4 overlap only a small area of the planar antenna 40, there is no interference with signal reception even if the hands are metal, but the hands are preferably made from a non-conductive material because any interference with signal reception can be avoided.

Planar Antenna

GPS satellites S transmit right-hand circularly polarized satellite signals. As a result, the planar antenna 40 according to this embodiment is a patch antenna (also called a microstrip antenna) with excellent circular polarization characteristics.

As shown in FIG. 5, the planar antenna 40 according to this embodiment is a patch antenna having a conductive antenna electrode 42 on a ceramic dielectric substrate 41.

This planar antenna 40 is manufactured as described below. First, barium titanate with a dielectric constant of 60-100 is formed to the desired shape in a press and sintered to complete the ceramic dielectric substrate 41 of the antenna. Aground electrode 43 forming the ground plane (GND) of the antenna is made by screen printing a primarily silver (Ag) paste, for example, on the back side (the side facing the circuit board 23) of the dielectric substrate 41.

A radiating antenna electrode 42 that determines the antenna frequency and the polarity of the received signals is formed on the face side of the dielectric substrate 41 (the side facing the base plate 21 and dial 2) by the same method as the ground electrode 43. The antenna electrode 42 is slightly smaller than the surface of the dielectric substrate 41, and an exposed surface 411 where the antenna electrode 42 is not present is disposed around the antenna electrode 42 on the surface of the dielectric substrate 41.

Figure 7:
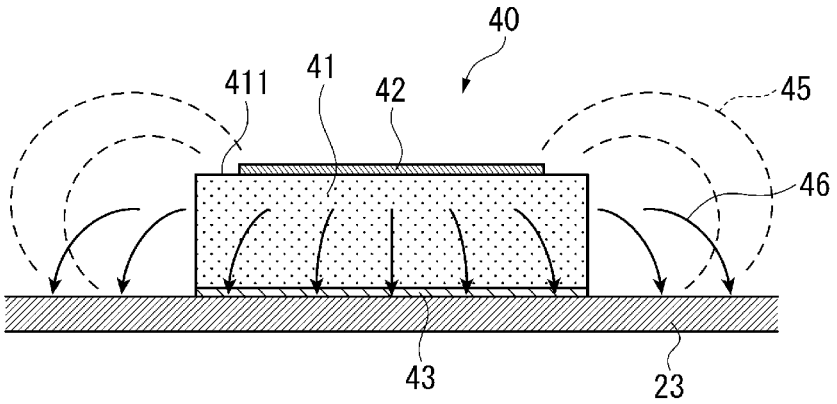
FIG. 7 is a section view illustrating the configuration of the planar antenna in the electronic timepiece.

FIG. 7 illustrates the operating principle of a planar antenna 40 (patch antenna). In FIG. 7 the dotted lines 45 represent radio waves received by the planar antenna 40, and the arrows 46 represent the electric lines of force.

A square patch antenna resonates when one side is a half wavelength, and a round patch antenna resonates when the diameter is approximately 0.58 wavelength, but the size of the antenna size can be reduced by the wavelength shortening effect of a dielectric. A patch antenna works by the strong electric field around the edge of the patch (antenna electrode 42) radiating from the edge into space, and the electric lines of force become stronger with proximity to the antenna and are easily affected by the effects of nearby metals and dielectrics. To receive GPS satellite signals, therefore, the distance between the metal outside case member 111 and the antenna electrode 42 must be at least 3 mm, and is ideally approximately 4 mm.

In this example, the walls 214 are located between the planar antenna 40 and outside case member 111, and the planar antenna 40 is disposed to a position separated at least a specific distance from the inside surface of the outside case member 111. As a result, a drop in reception performance due to the proximity of the planar antenna 40 to the metal outside case member 111 can be suppressed, and the reception performance required by the electronic timepiece 1 can be assured.

The planar antenna 40 is mounted on the circuit board 23, and is electrically connected to the GPS antenna module, which is the reception module 50 on the back side of the circuit board 23. The circuit board 23 can also function as a ground plane by connecting the ground electrode 43 of the planar antenna 40 through the ground pattern of the circuit board 23 to the ground node of the reception module 50. The outside case member 111 and back cover 12 can also be used as the ground plane by connecting the ground node of the reception module 50 through the ground pattern of the circuit board 23 to the metal outside case member 111 or back cover 12.

The planar antenna 40 is held in the antenna housing 21C by affixing the circuit board 23 to the base plate 21. Because the planar antenna 40 receives high frequency 1.54542 GHz signals, and includes a ceramic dielectric substrate 41 with a high dielectric constant, the planar antenna 40 is susceptible to the effects of surrounding parts. The base plate 21 is plastic, but has a dielectric constant of 3-4, and affects the reception frequency if the gap between the base plate 21 and the antenna electrode 42 is less than approximately 1.0 mm. More specifically, the antenna frequency may shift and reception performance drop if the gap between the base plate 21 and the antenna electrode 42 varies even slightly.

As shown in FIG. 3 to FIG. 6, a through-hole 216 is formed in the antenna housing 21C of the base plate 21 in the surface opposite the antenna electrode 42 of the planar antenna 40, that is, the surface on the dial 2 side.

The through-hole 216 in this example is formed overlapping all of the antenna electrode 42 in plan view. More specifically, because the antenna electrode 42 is substantially rectangular in plan view, the through-hole 216 is also rectangular in plan view when seen from the dial side of the electronic timepiece 1.

The length W1 of one side of the rectangular through-hole 216 is greater than the length W2 of one side of the antenna electrode 42 and less than the length W3 of one side of the dielectric substrate 41. Note that as shown in FIG. 6 the length of each of the four sides of the through-hole 216 is the same, but the through-hole 216 may be formed as a rectangle with different length and width dimensions in plan view.

By thus providing a through-hole 216 superimposed in plan view on the antenna electrode 42, the base plate 21 (dielectric) does not cover and is not closer than 1.0 mm to the antenna electrode 42, and the antenna frequency is prevented from shifting due to variation in the gap between the antenna electrode 42 and the dielectric base plate 21.

The length W4 between the walls 214 is greater than length W3 and is set to a dimension that accommodates the dielectric substrate 41 of the planar antenna 40. The cover parts 215 protruding from the walls 214 are formed overlapping the exposed surface 411 of the dielectric substrate 41 in plan view.

A sponge or other type of shock absorber 47 is also disposed between the exposed surface 411 and the cover parts 215. The position of the planar antenna 40 in the thickness direction of the timepiece is set by holding the dielectric substrate 41 against the shock absorber 47.

The ceramic dielectric substrate 41 is also hard and easily chipped, but contact between the dielectric substrate 41 and the base plate 21 can be prevented by the intervening shock absorber 47. Damage to the dielectric substrate 41 by collision with the base plate 21 can therefore also be prevented.

Part of the date wheel 5 is also disposed on the dial 2 side of the planar antenna 40. Because the antenna electrode 42 and date wheel 5 are separated by at least the thickness of the cover parts 215, the date wheel 5 is prevented from causing the antenna frequency to shift.

Circuit Configuration of the Electronic Timepiece

The circuit design of the electronic timepiece 1 is described next with reference to FIG. 8.

Figure 8:
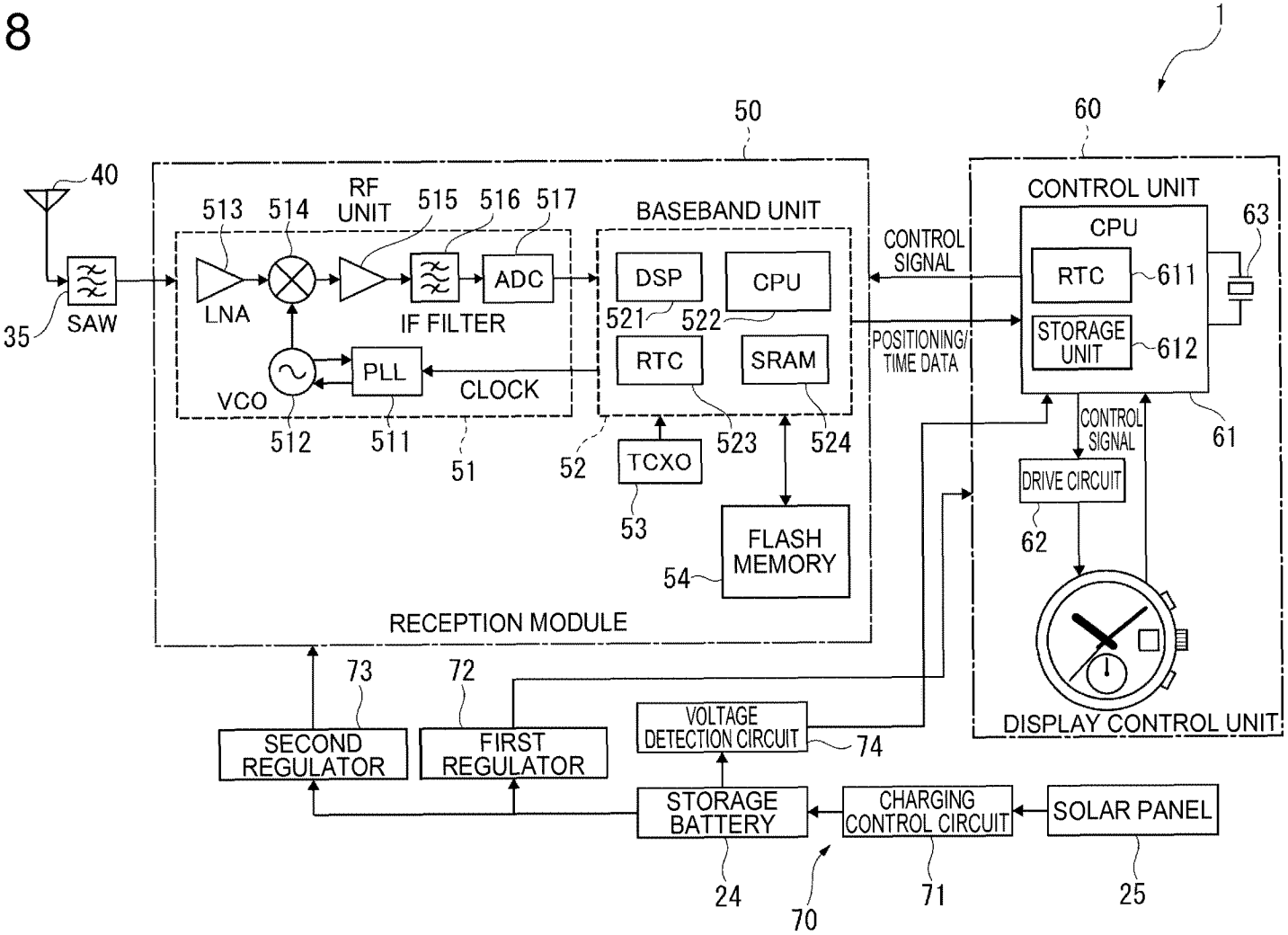
FIG. 8 is a block diagram illustrating the circuit design of the electronic timepiece.

As shown in FIG. 8, the electronic timepiece 1 has a planar antenna 40, a SAW filter 35, the reception module 50, a display control unit 60, and a power supply unit 70.

The SAW filter 35 is a bandpass filter that passes signals in the 1.5 GHz waveband. A LNA (low noise amplifier) may also be disposed between the planar antenna 40 and the SAW filter 35 to improve reception sensitivity.

Note also that the SAW filter 35 may be embedded in the reception module 50.

The reception module 50 processes satellite signals passed through the SAW filter 35, and includes an RF (radio frequency) unit 51 and a baseband unit 52.

The RF unit 51 includes a PLL (phase-locked loop) circuit 511, a VCO (voltage controlled oscillator) 512, a LNA (low noise amplifier) 513, a mixer 514, an IF (intermediate frequency) amplifier 515, an IF filter 516, and an A/D converter 517.

The satellite signal passed by the SAW filter 35 is amplified by the LNA 513, mixed by the mixer 514 with the clock signal output by the VCO 512, and down-converted to a signal in the intermediate frequency band.

The IF signal from the mixer 514 is amplified by the IF amplifier 515, passed through the IF filter 516, and converted to a digital signal by the A/D converter 517.

The baseband unit 52 includes, for example, a DSP (digital signal processor) 521, CPU (central processing unit) 522, a RTC (real-time clock) 523, and SRAM (static random access memory) 524. A TCXO (temperature compensated crystal oscillator) 53 and flash memory 54 are also connected to the baseband unit 52.

A digital signal is input from the A/D converter 517 of the RF unit 51 to the baseband unit 52, which acquires satellite time information and navigation information by a correlation process and positioning computation process.

Note that the clock signal for the PLL circuit 511 is generated by the TCXO 53.

The display control unit 60 includes a control unit (CPU) 61, a drive circuit 62 that drives the hands 3, 4, a time display unit, and information display unit.

The control unit 61 includes a RTC 611 and storage unit 612.

The RTC 611 calculates the internal time information using a reference signal output from a crystal oscillator 63.

The storage unit 612 stores the satellite time information and positioning information output from the reception module 50. Time difference data corresponding to the positioning information is also stored in the storage unit 612, and the local time at the current location can be calculated from the time difference data and the internal time kept by the RTC 611.

The electronic timepiece 1 in this example can also automatically correct the displayed time based on the satellite signals received from the GPS satellites S using the reception module 50 and display control unit 60 described above.

The power supply unit 70 includes the solar panel 25, a charging control circuit 71, the storage battery 24, a first regulator 72, a second regulator 73, and a voltage detection circuit 74.

When light is incident and the solar panel 25 produces power, the power obtained by photovoltaic generation is passed by the charging control circuit 71 to the storage battery 24 to charge the storage battery 24.

The storage battery 24 supplies drive power through the first regulator 72 to the display control unit 60, and supplies power through the second regulator 73 to the reception module 50.

The voltage detection circuit 74 monitors the output voltage of the storage battery 24, and outputs to the control unit 61. The control unit 61 can therefore know the storage battery 24 voltage and control the reception process.

Operating Effect

By forming a through-hole 216 in the base plate 21 overlapping all of the antenna electrode 42 of the planar antenna 40 in plan view, the base plate 21 is not present near the antenna electrode 42, and the antenna frequency is prevented from shifting due to the dielectric base plate 21 being close to the antenna electrode 42. As a result, variation in the antenna frequency is reduced and antenna performance is stabilized.

Furthermore, because a through-hole 216 is opposite the antenna electrode 42, the distance between the exposed surface 411 of the planar antenna 40 and the cover parts 215 of the base plate 21 can be reduced. As a result, the movement 20 housing the planar antenna 40 inside can be made thinner, and the electronic timepiece 1 can also be made thinner.

Furthermore, because cover parts 215 that overlap at least part of the exposed surface 411 of the planar antenna 40 in plan view are formed with the base plate 21, the planar antenna 40 can be prevented from moving to the face side of the timepiece. The planar antenna 40 can therefore be prevented from passing through the through-hole 216 in the base plate 21 and striking the dial 2 or date wheel 5 in the event the electronic timepiece 1 is dropped, for example.

Furthermore, because a shock absorber 47 is placed between the cover parts 215 of the base plate 21 and the exposed surface 411 of the dielectric substrate 41, and the exposed surface 411 of the planar antenna 40 is set against the shock absorber 47, the planar antenna 40 can be precisely positioned in the height (thickness) direction of the electronic timepiece 1. As a result, the positioning precision of the planar antenna 40 to the base plate 21 can be improved, change in the antenna frequency due to deviation in positioning precision can be further reduced, and antenna performance can be further stabilized.

Furthermore, because the exposed surface 411 of the planar antenna 40 contacts the shock absorber 47, direct contact with the cover parts 215 can be prevented, and damage to the ceramic dielectric substrate 41 can be prevented.

Furthermore, because the date wheel 5 is made from a non-conductive material, a drop in reception performance can be prevented even if the date wheel 5 overlaps the planar antenna 40 in part in plan view because the satellite signals can pass through the date wheel 5 to the antenna.

Furthermore, because the date wheel 5 overlaps the planar antenna 40 in plan view, there is greater freedom positioning the center pivot 3A and pivot 4A of the hands 3 and small hand 4 to avoid the date wheel 5 and planar antenna 40, and the electronic timepiece 1 can be designed with a greater degree of freedom.

Furthermore, because the planar antenna 40 does not overlap the solar panel 25 in plan view, satellite signals passed from the face side of the timepiece are incident to the planar antenna 40 without being obstructed by the solar panel 25. A solar panel 25 can therefore be disposed to the electronic timepiece 1 without reducing reception performance.

Because the planar antenna 40 does not overlap the main case 11 (outside case member 111 and bezel 112) in plan view when seen from the front of the timepiece, satellite signals pass from the front of the timepiece through the crystal 31 and are incident to the planar antenna 40 without being obstructed by the main case 11. Metal or other conductive material can therefore be used for the main case 11 and back cover 12 without reducing reception performance, and the apparent quality of the electronic timepiece 1 can be improved.

Furthermore, because the bezel 112 is made from a conductive material, the bezel 112 can be manufactured more easily than when using ceramic, freedom of design can therefore be improved, and cost can be reduced. Furthermore, because the bezel 112 is metal, greater rigidity can be achieved in a smaller sectional area than with a ceramic bezel. The sectional width of the ring-shaped bezel 112 can therefore be reduced, the planar size of the crystal 31 can be increased, and the freedom of timepiece design can be improved.

Furthermore, because the outside case member 111 and back cover 12 are connected to ground of the reception module 50, they can also function as the ground plane. As a result, the area of the ground plane can be increased, antenna gain can be improved, and antenna performance can be improved.

Other Embodiments

The invention is not limited to the embodiment doves, and can be varied in many ways without departing from the technical scope of the invention.

Figure 9:
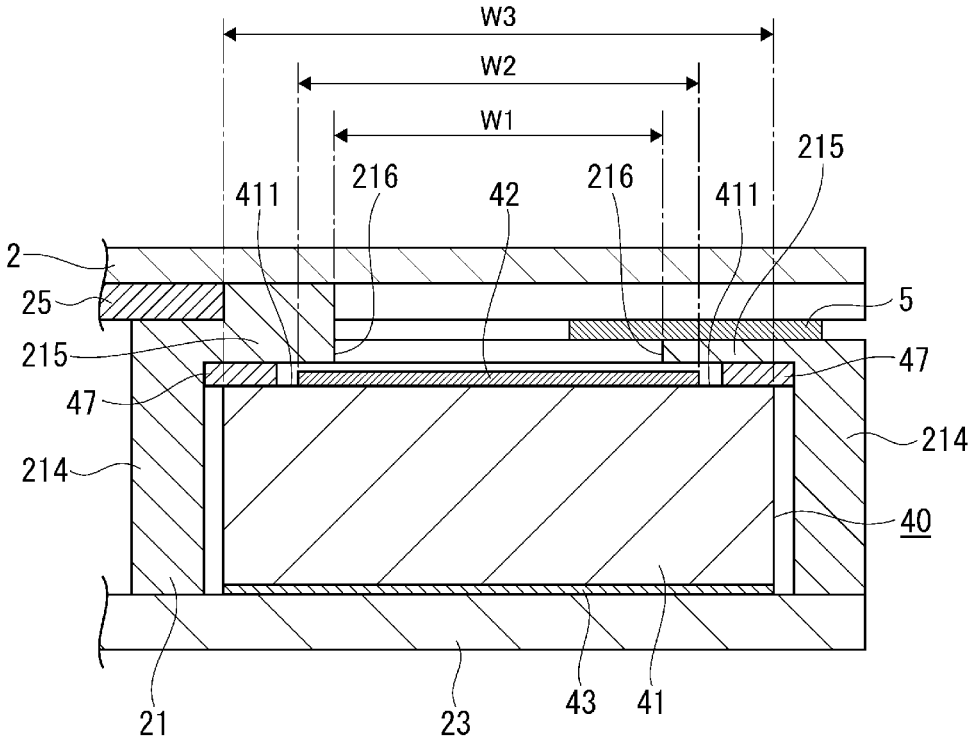
FIG. 9 is a section view illustrating the relative positions of the planar antenna and a through-hole in the base plate of an electronic timepiece according to another embodiment of the invention.

The through-hole 216 formed in the antenna housing 21C of the base plate 21 is preferably sized to overlap the entire antenna electrode 42 of the planar antenna 40 in plan view. As shown in FIG. 9, however, the length W1 of one side of the through-hole 216 may be made smaller than the length W2 of one side of the antenna electrode 42, and the cover parts 215 may be formed to overlap part of the antenna electrode 42 in plan view.

In this case, compared with when a through-hole 216 is not formed in the base plate 21, less of the base plate 21 or dielectric body is close to the antenna electrode 42, the effect of a dielectric causing the antenna frequency to shift can be reduced, and antenna performance can be stabilized.

As also shown in FIG. 9, when the antenna electrode 42 and the base plate 21 (cover parts 215) overlap in plan view, the area of overlap is preferably as small as possible to reduce the antenna frequency shifting effect, and the area of overlap is preferably 30% or less of the area of the antenna electrode 42.

Figure 10:
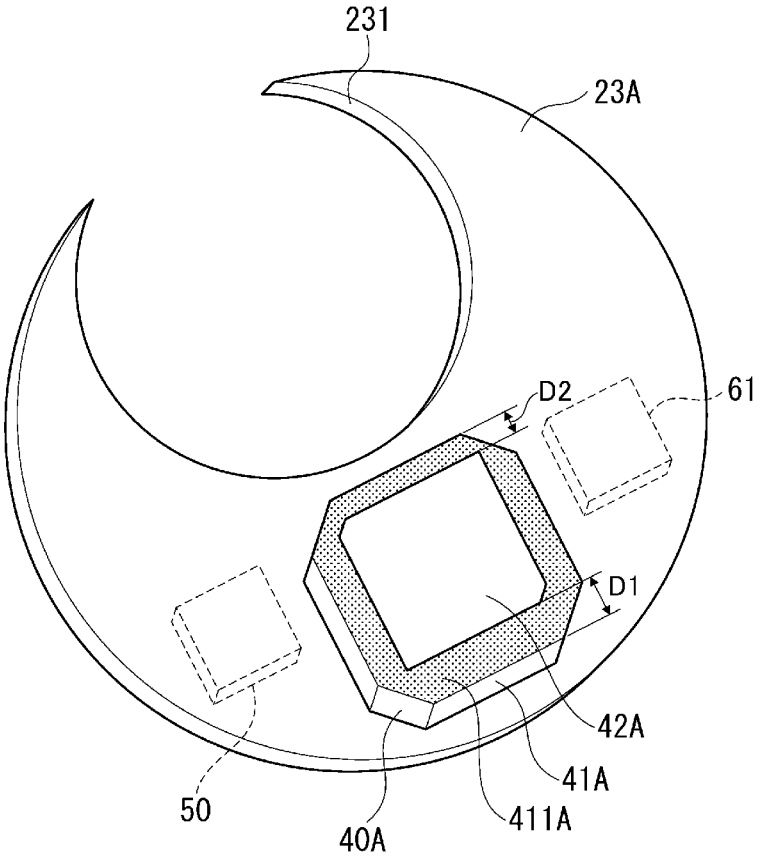
FIG. 10 is an oblique view illustrating the planar antenna and circuit board of the electronic timepiece according to another embodiment of the invention.

A circuit board 23A and a planar antenna 40A as shown in FIG. 10 may also be used. To make the electronic timepiece 1 thinner, a through-hole 231 is formed in the part of the circuit board 23A overlapping the storage battery 24 in plan view. The thickness of the movement 20 can then be reduced by disposing the stepper motor, wheel train, and other parts of the drive module 22 to positions not overlapping the storage battery 24 in plan view.

The reception module 50, control unit 61, and other circuit components are mounted on the circuit board 23A on the opposite side as the side on which the planar antenna 40A is mounted. As a result, as described in the foregoing embodiment, the planar antenna 40 is shielded from digital noise from the reception circuit and power supply circuit, and reception sensitivity can be improved.

The antenna electrode 42A on the surface of the dielectric substrate 41A of the planar antenna 40A is formed at a position offset toward the planar center of the circuit board 23A, that is, offset toward the planar center of the electronic timepiece 1. As a result, in the exposed surface 411A on the surface of the dielectric substrate 41A, the width D1 of the exposed surface 411A from the antenna electrode 42A to the outside case member 111 side is greater than the width D2 of the exposed surface 411A from the antenna electrode 42A to the planar center of the circuit board 23A. More specifically, the planar center of the antenna electrode 42A does not match the planar center of the dielectric substrate 41A, and is closer to the planar center of the electronic timepiece 1 than the planar center of the dielectric substrate 41A.

In plan view, the width D1 can also be expressed as the distance from the side of the antenna electrode 42A closest to the outside case member 111 to the side of the dielectric substrate 41A closest to the outside case member 111. Width D2 can also be expressed as the distance from the side of the antenna electrode 42A closest to the planar center of the electronic timepiece 1 to the side of the dielectric substrate 41A closest to the planar center of the electronic timepiece 1.

By disposing the planar antenna 40A with the antenna electrode 42A separated from the metal outside case member 111, the radio frequency shielding effect of the metal outside case member 111 can be reduced.

The embodiment described above has a shock absorber 47, but this shock absorber 47 may be omitted. In this case, the exposed surface 411 of the planar antenna 40 may be set in contact with the cover parts 215. The exposed surface 411 of the planar antenna 40 may also be disposed not touching the cover parts 215 with a gap therebetween.

The main case 11 in the foregoing embodiment includes a outside case member 111 and bezel 112, but the invention is not so limited. More specifically, the main case 11 may comprise only an outside case member 111.

The bezel 112 in the foregoing embodiment is made from a conductive material, but the invention is not so limited. For example, the bezel 112 may be made of a ceramic such as zirconia ($ZrO_2$), which is a non-conductive material. Zirconia has high resistivity, does not adversely affect signal reception, is hard, offers excellent scratch resistance, and is outstanding when used as an external member of a timepiece. If the bezel 112 is ceramic, the bezel 112 and the antenna electrode 42 may overlap in plan view. As a result, there is no need to increase the diameter of the outside case member 111 so that the bezel 112 does not overlap the antenna electrode 42 in plan view, the diameter of the outside case member 111 can be reduced, and the plane size of the electronic timepiece 1 can be reduced.

The electronic timepiece 1 in the foregoing embodiment has a date wheel 5, solar panel 25, and dial ring 32, but the invention is not so limited. More specifically, the electronic timepiece may be made without a date wheel 5, solar panel 25, and dial ring 32.

The outside case member 111 and back cover 12 touch the ground of the reception module 50 in the foregoing embodiments, but the invention is not so limited. More specifically, the outside case member 111 and back cover 12 do not need to connect to the ground.

The electronic timepiece in the foregoing embodiments has a time display unit comprising a dial 2 and hands 3, but the invention is not so limited. The electronic timepiece may be made with an LCD panel as the time display unit, for example. In this event, the drive module that drives the time display unit may be a drive unit that drives the LCD panel.

In this case, the electronic timepiece simply requires a time display function, and the time display unit need not be a display unit for displaying only the time. Examples of such electronic timepieces are wrist-wearable devices such as heart rate monitors that are worn on the user's wrist to measure the heart rate, and GPS loggers that are worn on the wrist and measure the user's current location while the user is jogging.

The foregoing embodiments are described with reference to a GPS satellite as an example of a positioning information satellite, but the positioning information satellite of the invention is not limited to GPS satellites and the invention can be used with Global Navigation Satellite Systems (GNSS) such as Galileo (EU), GLONASS (Russia), and Beidou (China). The invention can also be used with geostationary satellites in satellite-based augmentation systems (SBAS), and quasi-zenith satellites in radio navigation satellite systems (RNSS) that can only search in specific regions. The invention can also be used in configurations that receive and process satellite signals from multiple systems.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2014-208140, filed Oct. 9, 2014 is expressly incorporated by reference herein.

What is claimed is:

1. An electronic timepiece comprising:

a base plate made from a non-conductive material;

a planar antenna disposed on a first side of the base plate facing a back cover and including a dielectric substrate and an antenna electrode, wherein the antenna electrode is disposed on a surface of the dielectric substrate facing the base plate, an exposed surface where the antenna electrode is not present on the surface of the dielectric substrate; and a solar panel disposed on a second side of the base plate opposite the back cover, wherein the base plate has a through-hole overlapping the antenna electrode at least in part in plan view, a cover part of the base plate overlaps 0% to 30% of the area of the antenna electrode and overlaps the exposed surface of the dielectric substrate at least in part in plan view, the solar panel does not overlap the planar antenna, and the antenna electrode is disposed on the dielectric substrate such that a planar center of the antenna electrode is closer to a planar center of the electronic timepiece than a planar center of the dielectric substrate is to the planar center of the electronic timepiece.

2. The electronic timepiece described in claim 1, wherein:

a shock absorber is disposed between the cover part and the exposed surface.

3. The electronic timepiece described in claim 1, wherein:

the through-hole is formed overlapping all of the antenna electrode in plan view.

4. The electronic timepiece described in claim 1, further comprising:

a calendar wheel made from a non-conductive material and displaying calendar information;

wherein the planar antenna is disposed to a position overlapping the calendar wheel in plan view.

5. The electronic timepiece according to claim 1, wherein the antenna electrode is formed at a position that is offset relative to a center of the timepiece.

* * * * *